US006734362B2

(12) United States Patent
Buck et al.

(10) Patent No.: US 6,734,362 B2
(45) Date of Patent: May 11, 2004

(54) FLEXIBLE HIGH-IMPEDANCE INTERCONNECT CABLE HAVING UNSHIELDED WIRES

(75) Inventors: Arthur Buck, Sherwood, OR (US); Laurence A. Daane, Wilsonville, OR (US)

(73) Assignee: Ludlow Company LP, Exeter, NH (US)

( * ) Notice: Subject to any disclaimer, the term of this patent is extended or adjusted under 35 U.S.C. 154(b) by 0 days.

(21) Appl. No.: 10/290,590

(22) Filed: Nov. 7, 2002

(65) Prior Publication Data

US 2003/0111255 A1 Jun. 19, 2003

Related U.S. Application Data

(63) Continuation-in-part of application No. 10/025,096, filed on Dec. 18, 2001, now Pat. No. 6,580,034.

(51) Int. Cl.[7] ..... H01B 7/04
(52) U.S. Cl. ..... 174/113 R; 174/36; 174/117 F
(58) Field of Search ..... 174/113 R, 117 F, 174/36

(56) References Cited

U.S. PATENT DOCUMENTS 4,767,891 A * 8/1988 Biegon et al. ..... 174/34
4,800,236 A * 1/1989 Lemke ..... 174/36
5,428,189 A * 6/1995 Dorner et al. ..... 174/117 F
5,864,094 A * 1/1999 Griffin ..... 174/105 R
2003/0085052 A1 * 5/2003 Tsao et al. ..... 174/113 R

FOREIGN PATENT DOCUMENTS

GB 2 084 811 * 4/1982

* cited by examiner

*Primary Examiner*—Chau N. Nguyen
(74) *Attorney, Agent, or Firm*—Bennet K. Langlotz; Langlotz Patent Works, Inc.

(57) ABSTRACT

A cable assembly has a number of wires each having a central conductor and a surrounding insulating layer. Each wire is unshielded from the other wires, so that the conductor is the only conductive portion of the wire. Each wire has a first end and an opposed second end. The first ends of the wires are secured to each other in a flat ribbon portion in a first sequential arrangement, and the second ends of the wires are secured to each other in the same sequence as the first arrangement, with indicia identifying a selected wire in the sequence. The intermediate portions of the wires are detached from each other, and a sheath having a braided conductive shield may loosely encompass the wires, permitting significant flexibility of the cable.

26 Claims, 7 Drawing Sheets

FLEXIBLE HIGH-IMPEDANCE INTERCONNECT CABLE HAVING UNSHIELDED WIRES

REFERENCE TO RELATED APPLICATION

This is a Continuation-In-Part of U.S. patent application Ser. No. 10/025,096, filed Dec. 18, 2001 now U.S. Pat. No. 6,580,034.

FIELD OF THE INVENTION

This invention relates to multiple-wire cables, and more particularly to small gauge wiring for high frequencies.

BACKGROUND OF THE INVENTION

Certain demanding applications require miniaturized multi-wire cable assemblies. To avoid undesirably bulky cables when substantial numbers of conductors are required, very fine conductors are used. To limit electrical noise and interference, coaxial wires having shielding are normally used for the conductors. A dielectric sheath surrounds a central conductor, and electrically separates it from the conductive shielding. A bundle of such wires is surrounded by a conductive braided shield, and an outer protective sheath.

Some applications requiring many different conductors prefer that a cable be very flexible, supple, or "floppy." In an application such as a cable for connection to a medical ultrasound transducer, a stiff cable with even moderate resistance to flexing can make ultrasound imaging difficult. However, with conventional approaches to protectively sheathing cables, the bundle of wires may be undesirably rigid. In addition, it is desired that the cable be relatively light weight, so that it does not require significant effort to hold an ultrasound transducer in position for imaging. Presently, ultrasound technicians loop a portion of the cable about their wrists to support the cable without it tugging on the transducer.

The need for flexible and lightweight cables is met by the use of very fine gauge wires. While effective, the process of manufacturing fine gauge coaxial wires is exacting and costly. To achieve the needed overall wire diameter, the center conductor and the helically-wound shield wires must be extremely fine, approaching the limits of practical manufacturability. While past cables for some uses have employed unshielded conductors, these are well-known to be unsuitable for applications such as medical ultrasound imaging that require high impedance, low capacitance, and very limited cross talk.

In addition, cable assemblies having a multitude of conductors may be time-consuming and expensive to assemble with other components. When individual wires are used in a bundle, one can not readily identify which wire end corresponds to a selected wire at the other end of the bundle, requiring tedious continuity testing. Normally, the wire ends at one end of the cable are connected to a component such as a connector or printed circuit board, and the connector or board is connected to a test facility that energizes each wire, one-at-a-time, so that an assembler can connect the identified wire end to the appropriate connection on a second connector or board.

A ribbon cable in which the wires are in a sequence that is preserved from one end of the cable to the other may address this particular problem. However, with all the wires of the ribbon welded together, they resist bending, creating an undesirably stiff cable. Moreover, a ribbon folded along multiple longitudinal fold lines may tend not to generate a compact cross section, undesirably increasing bulk, and may not provide a circular cross section desired in many applications.

SUMMARY OF THE INVENTION

The present invention overcomes the limitations of the prior art by providing a cable assembly that has a number of wires each having a central conductor and a surrounding insulating layer. Each wire is unshielded from the other wires, so that the conductor is the only conductive portion of the wire. Each wire has a first end and an opposed second end. The first ends of the wires are secured to each other in a flat ribbon portion in a first sequential arrangement, and the second ends of the wires are secured to each other in the same sequence as the first arrangement, with indicia identifying a selected wire in the sequence. The intermediate portions of the wires are detached from each other, and a sheath having a braided conductive shield may loosely encompass the wires, permitting significant flexibility of the cable.

DETAILED DESCRIPTION OF A PREFERRED EMBODIMENT

Figure 1:
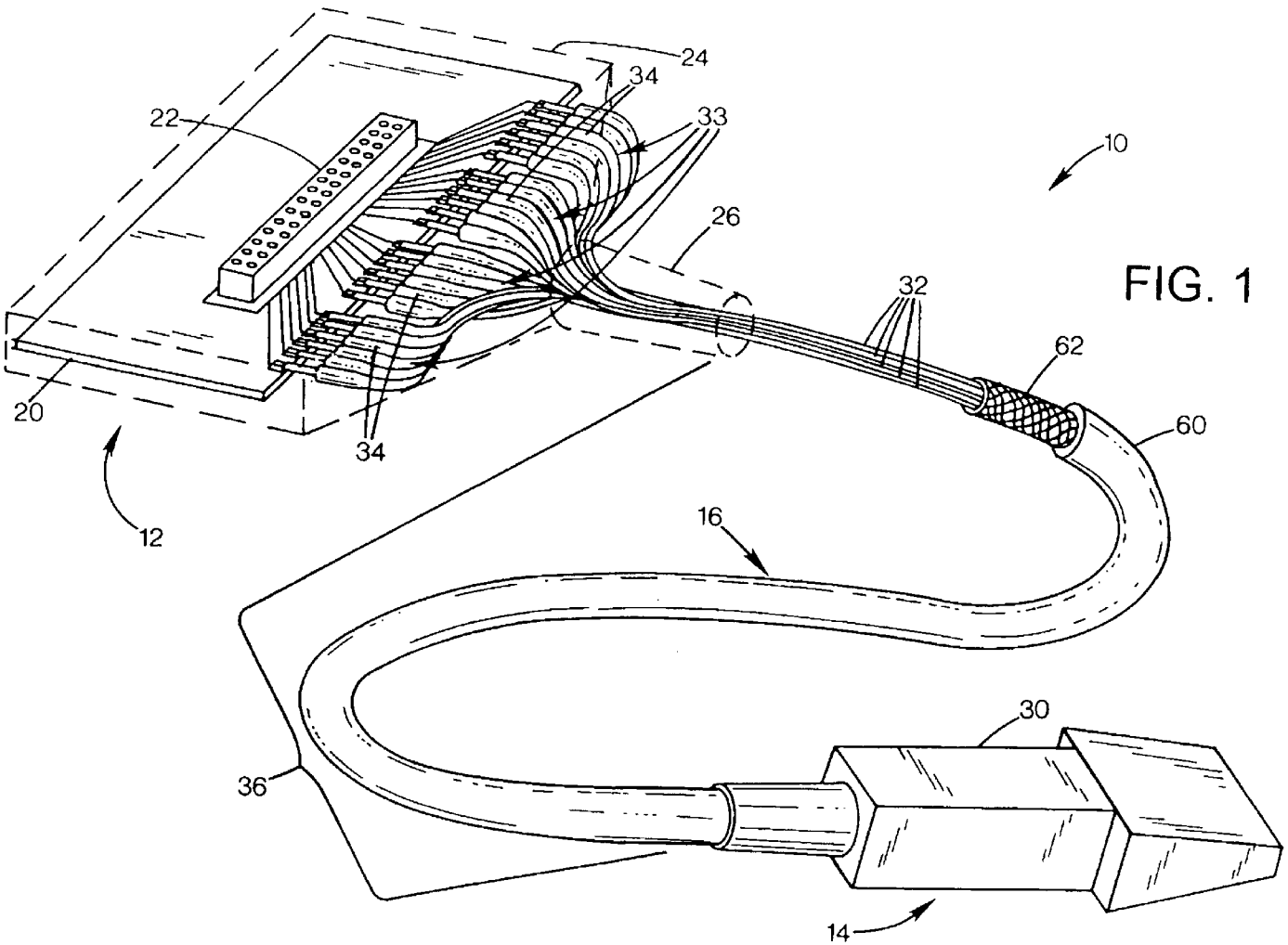
FIG. 1 is a perspective view of a cable assembly according to a preferred embodiment of the invention.

FIG. 1 shows a cable assembly 10 having a connector end 12, a transducer end 14, and a connecting flexible cable 16. The connector end and transducer ends are shown as examples of components that can be connected to the cable 16. In this example, the connector end includes a circuit board 20 with a connector 22 for connection to an electronic instrument such as an ultrasound imaging machine. The connector end includes a connector housing 24, and strain relief 26 that surrounds the end of the cable. On the opposite end, an ultrasound transducer 30 is connected to the cable.

Figure 2:
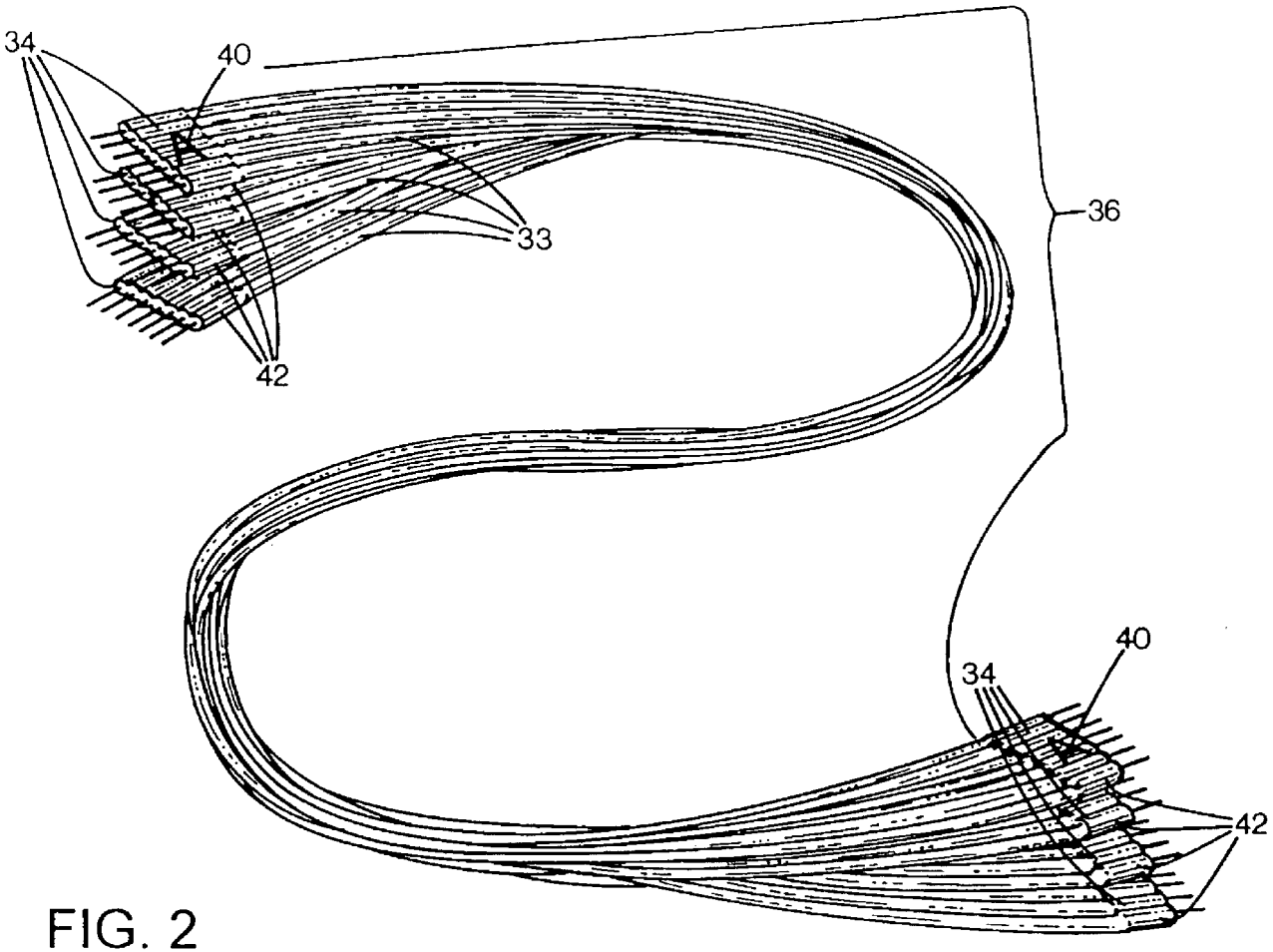
FIG. 2 is a perspective view of wiring components according to the embodiment of FIG. 1.

The cable 16 includes a multitude of fine coaxially shielded wires 32. As also shown in FIG. 2, the wires are arranged into groups 33, with each group having a ribbonized ribbon portion 34 at each end, and an elongated loose portion 36 between the ribbon portions and extending almost the entire length of the cable. Each ribbon portion includes a single layer of wires arranged side-by-side, adhered to each other, and trimmed to expose a shielding layer and center conductor for each wire. In the loose portion, the wires are unconnected to each other except at their ends.

The shielding and conductor of each wire are connected to the circuit board, or to any electronic component or connector by any conventional means, as dictated by the needs of the application for which the cable is used. The loose portions 36 of the wires extend the entire length of the cable between the strain reliefs, through the strain reliefs, and into the housing where the ribbon portions are laid out and connected.

The ribbon portions 34 are each marked with unique indicia to enable assemblers to correlate the opposite ribbon portions of a given group, and to correlate the ends of particular wires in each group. A group identifier 40 is imprinted on the ribbon portion, and a first wire identifier 42 on each ribbon portion assures that the first wire in the sequence of each ribbon is identified on each end. It is important that each group have a one-to-one correspondence in the sequence of wires in each ribbon portion. Consequently, an assembler can identify the nth wire from the identified first end wire of a given group "A" as corresponding to the nth wire at the opposite ribbon portion, without the need for trial-and-error continuity testing to find the proper wire. This correspondence is ensured, even if the loose intermediate portions 36 of each group are allowed to move with respect to each other, or with the intermediate portions of other groups in the cable.

Figure 3:
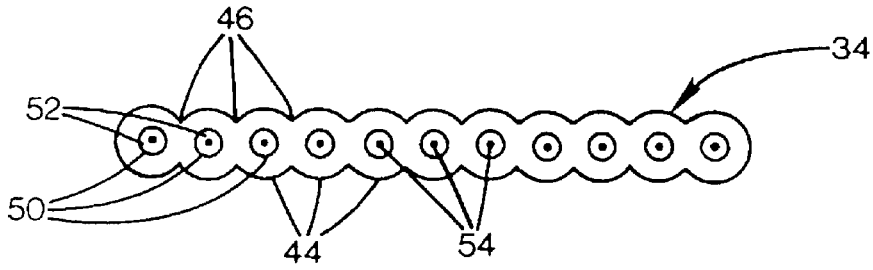
FIG. 3 is an enlarged sectional view of an end portion of a wiring component according to the embodiment of FIG. 1.

FIG. 3 shows a cross section of a representative end portion, with the wires connected together at their outer sheathing layers 44 at weld joints 46, while the conductive shielding 50 of each of the wires remains electrically isolated from the others, and the inner dielectric 52 and central conductors 54 remain intact and isolated. In alternative embodiments, the ribbon portions may be secured by the use of adhesive between abutting sheathing layers 44, by adhesion of each sheathing layer to a common strip or sheet, or by a mechanical clip.

Figure 4:
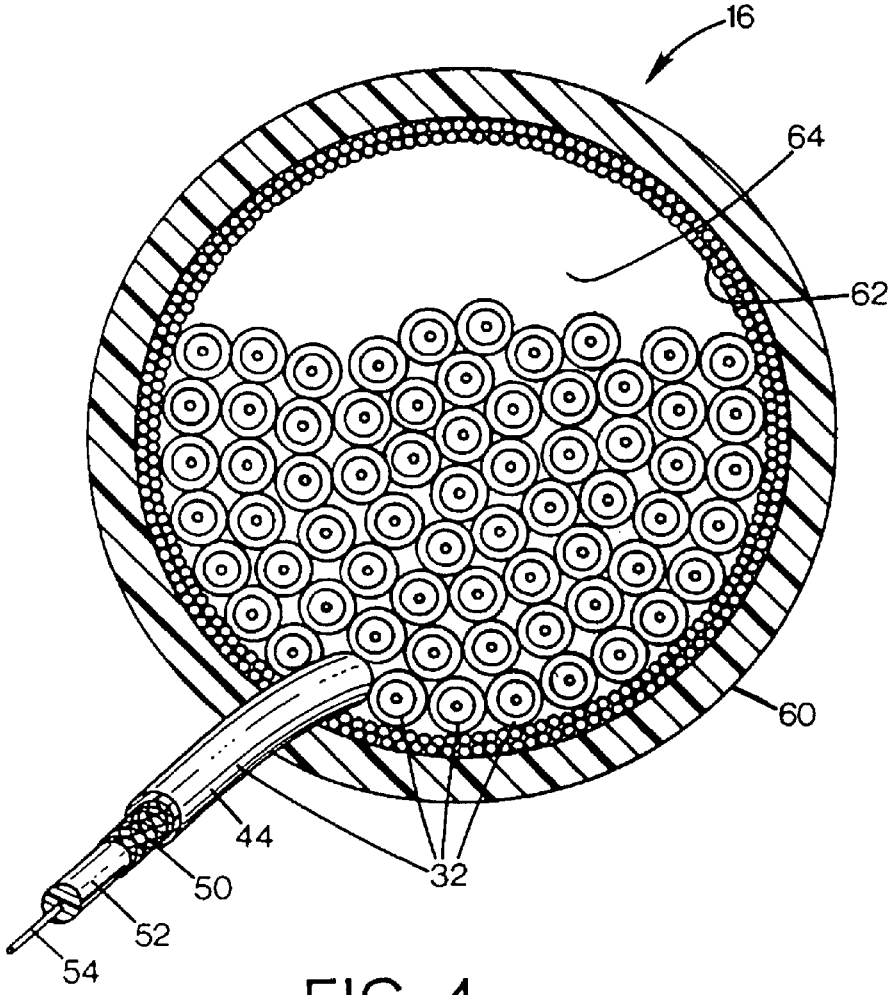
FIG. 4 is an enlarged sectional view of the cable assembly according to the embodiment of FIG. 1.
Figure 5:
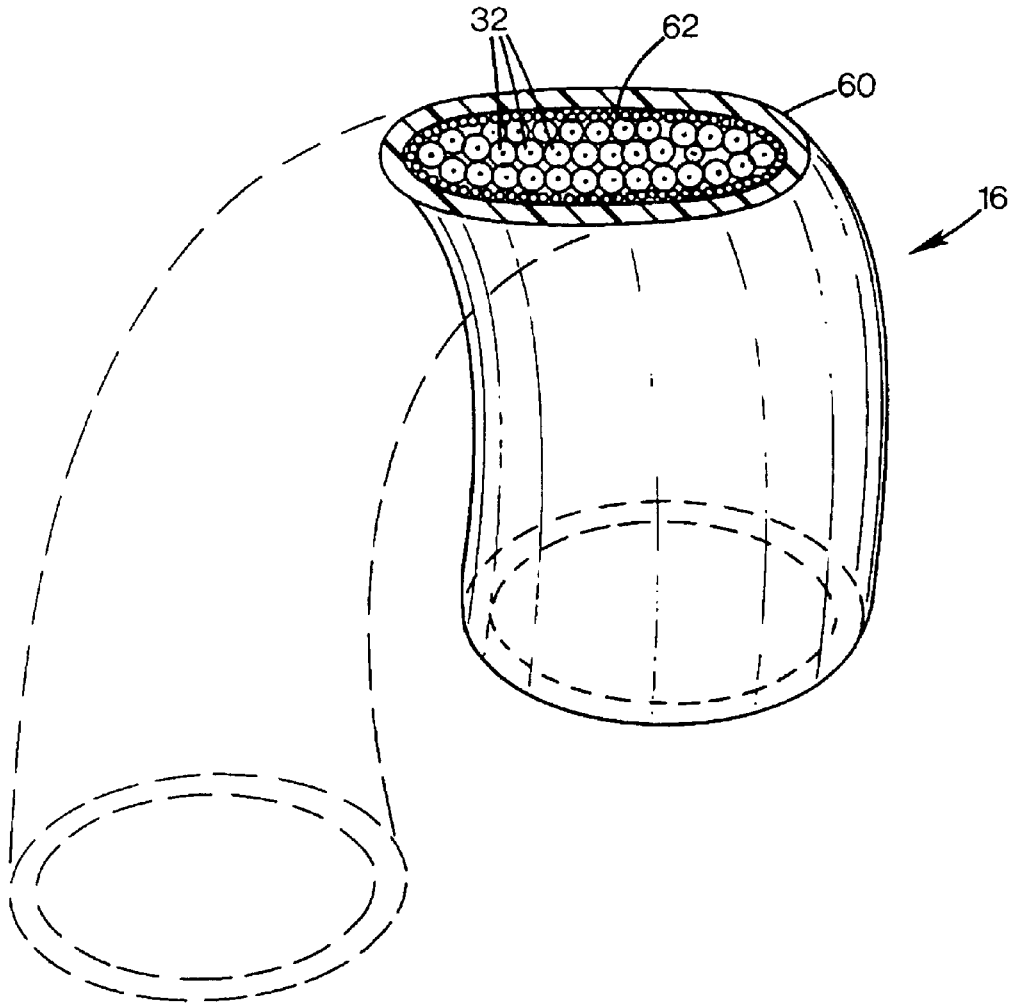
FIG. 5 is an enlarged sectional view of the cable assembly in a flexed condition according to the embodiment of FIG. 1.

FIG. 4 shows the cable cross section throughout most of the length of the cable, away from the ribbon portions, reflecting the intermediate portion. The wires are loosely contained within a flexible cylindrical cable sheath 60. As also shown in FIG. 1, a conductive braided shield 62 surrounds all the wires, and resides at the interior surface of the sheath to define a bore 64. Returning to FIG. 4, the bore diameter is selected to be somewhat larger than required to closely accommodate all the wires. This provides the ability for the cable to flex with minimal resistance to a tight bend, as shown in FIG. 5, as the wires are free to slide to a flattened configuration in which the bore cross section is reduced from the circular cross section is has when held straight, as in FIG. 4.

In the preferred embodiment, there are 8 groups of 16 wires each, although either of these numbers may vary substantially, and some embodiments may use all the wires in a single group. The wires preferably have an exterior diameter of 0.016 inch, although this and other dimensions may range to any size, depending on the application. The sheathing has an exterior diameter of 0.330 inch and a bore diameter of 0.270 inch. This yields a bore cross section (when straight, in the circular shape) of 0.057 inch. As the loose wires tend to pack to a cross-sectional area only slightly greater than the sum of their areas, there is significant extra space in the bore in normal conditions. This allows the wires to slide about each other for flexibility, and minimizes wire-to-wire surface friction that would occur if the wires were tightly wrapped together, such as by conventional practices in which a wire shield is wrapped about a wire bundle. In the preferred embodiment, a bend radius of 0.75 inch, or about 2 times the cable diameter, is provided with minimal bending force, such as if the cable is folded between two fingers and allowed to bend to a natural radius. Essentially, the bend radius, and the supple lack of resistance to bending is limited by little more than the total bending resistance of each of the components. Because each wire is so thin, and has minimal resistance to bending at the radiuses on the scale of the cable diameter, the sum of the wire's resistances adds little to the bending resistance of the sheath and shield, which thus establish the total bending resistance.

UNSHIELDED EMBODIMENT

Figure 6:
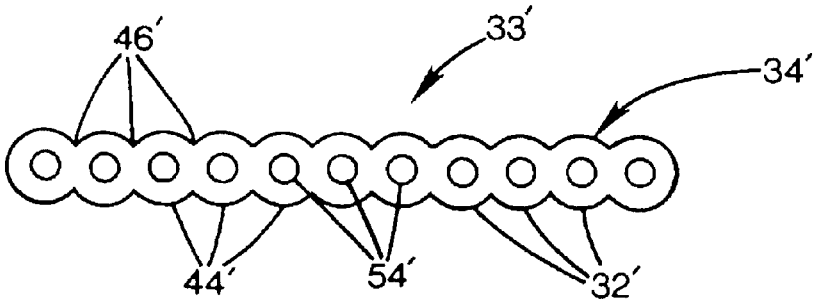
FIG. 6 is an enlarged cross-sectional view of a cable assembly component according to an alternative embodiment of the invention.

FIG. 6 shows a cross section of a representative end portion 34' of a wire group 33' according to an alternative embodiment of the invention. The alternative embodiment differs from the preferred embodiment in that the wires 32' that make up the cable are unshielded with respect to each other, and each has a central conductor 54' that comprises the only conductive portion of the wire. The only conductive portion of each wire is the central conductor, and the only conductors in the cable are the central conductors and the shield. The central conductor 54' is surrounded only by a single insulation layer or dielectric sheath 44'. This single layer is formed of a single material, providing simplified manufacturing.

As in the preferred embodiment, the wires are connected together at their sheaths 44' at weld joints 46'. In alternative embodiments, the ribbon portions may be secured by the use of adhesive between abutting sheathing layers 44', by adhesion of each sheathing layer to a common strip or sheet, by a mechanical clip, or by any means to provide ribbonized ends, including the individuation of the intermediate portions of a ribbon cable.

Figure 7:
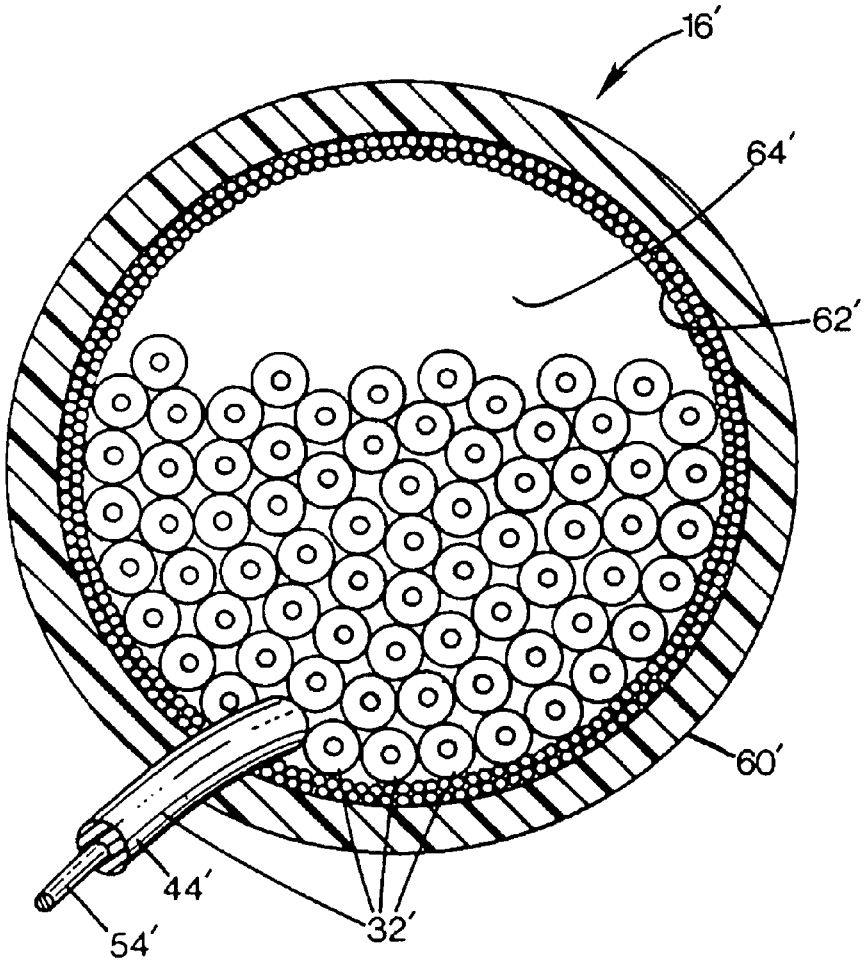
FIG. 7 is an enlarged cross-sectional view of a cable assembly according to the alternative embodiment of FIG. 6.

FIG. 7 shows an alternative embodiment cable 16' employing the cable groups 33' of FIG. 6. The section is taken at any intermediate location on the cable, away from the ribbonized end portions. The wires 32' are loosely contained within a flexible cylindrical cable sheath 60'. As with the preferred embodiment shown in FIG. 1, a conductive braided shield 62' loosely surrounds all the wires, and resides at the interior surface of the sheath to define a bore 64'. Returning to FIG. 7, the shield bore diameter is selected to be somewhat larger than is required to closely accommodate all the wires. This provides the ability for the cable to flex with minimal resistance to a tight bend, as shown in FIG. 5, as the wires are free to slide to a flattened configuration in which the bore cross section is reduced from the circular cross section it has when held straight, as in FIG. 6.

With the unshielded wires, the looseness is believed to be particularly important to cable performance. This is because the looseness permits the wires to meander with respect to other wires along the length of the intermediate portion, so that a given wire spends only a small fraction of the length adjacent to any other particular wire or sets of wires. If the shield or sheath were wrapped tightly about the wires during manufacturing, the arrangement of wires with respect to each other would be unlikely to be the product of random chance, but would be expected to follow a pattern established during assembly.

Thus, the looseness first ensures that a possible non-random pattern established at manufacturing is not preserved for the life of the device. Such a non-random pattern may be one in which the wires follow essentially straight paths, adjacent to the same other wires along the entire length, in the manner of a close-packed honeycomb cross section that does not allow wires to shift with respect to others along its length or over time. Secondly, the looseness allows the wires to move over time, so that the pattern does not remain fixed for the life of the device. As the cable is flexed during use, stowed for storage, and unstowed, the wires are believed to "crawl" about each other over the length of the cable, randomly assuming different patterns and positions over time. Thirdly, the wires' tendency to crawl causes them to assume different random patterns over the length of the cable, so that a wire can be expected to remain adjacent to another given wire for only a short portion of the cable length, limiting the effect that any other wire may have on it to cause crosstalk.

It is understood that the arrangement of wires at any position along the length has a minimal correlation with the pattern of wires a short distance along the length of the cable. Even for minimally short distance along the cable length, where a wire can not be expected to shift extremely from its position, it is believed that there is no reason to believe that the wire prefers or tends to remain in the same position, nor that two adjacent wires will tend to depart in the same direction, which would lead them to remain adjacent to each other for a significant portion of the cable length.

It is further understood that a wire tends to depart from a given position at a rate that allows (if randomness permitted) the wires to make several complete round trip transits across the full diameter of the cable. This is based on the tendency for it to depart laterally by a given amount over a given length, even though the meandering path would not in practice be expected to generate a sawtooth path from one side of the shield to the other. Because each wires spends little distance near any one other wire, its potential to cause cross talk on other wires is distributed broadly among the other wires, where the effect is minimal, and tolerated for many applications. For ultrasound imaging, where the transducer has an inherently limited signal to noise ratio of about 35 dB, the performance of the preferred example of the alternative embodiment is well matched, with comparable observed performance in acoustic crosstalk.

In the preferred example of the alternative embodiment, there are 7 groups of 18 wires each, although either of these numbers may vary substantially, and some embodiments may use all the wires in a single group. The wires have conductors that may either be single or stranded, and are insulated with a material suitable for ribbonization and with the desired dielectric constant. For cabling used in the exemplary ultrasound imaging application, typical conductor would be 38 to 42 AWG high strength copper alloy. Insulation would preferably be a low-density polyolefin, but using fluoropolymers is also feasible. The dielectric constant is preferably in the range of 1.2 to 3.5.

A ribbonized end portion of the wires length of conductors is substantially exterior to cable jacket and shielding. The end portions are ribbonized at a pitch or center-to-center spacing that is uniform, and selected to match the pads of the circuit board to which it is to be attached. In a preferred example of the alternative embodiment, the conductors are single strand 40 AWG copper (0.0026" diameter), and the insulation is microcellular polyolefin with a wall thickness of 0.006", providing an overall wire diameter of 0.015". This is well-suited to provide an end-portion ribbonized pitch of 0.014". Alternative dielectric materials include other solid, foamed, or other air-enhanced low-temperature compounds and fluoropolymers.

The alternative embodiment has several performance differences from the preferred embodiment. The use of unshielded conductors yields a lower capacitance per foot. Comparing the above examples, the shielded version has a capacitance of about 17 pF per foot, compared to 7 pF per foot in the unshielded non-coax alternative, using 40 AWG conductors in the example. The expected calculated capacitance of the unshielded version is 12 pF/ft, so the desirable lower capacitance is an unexpected result. It is believed that the neighboring wires function as shielding for each wire, so that the effective spacing between the conductor and shield is not entirely based on the gap to the outer cable shield, but based on this nominal distance to adjacent wire conductors. While using signal-carrying conductors as shielding for other signal carrying wires would have been expected to yield undesirable crosstalk, the random positioning and meandering of the wires limits this effect to levels that are well-tolerated for important applications.

The unshielded alternative generally has a lower manufacturing cost, because there is no need for the materials and process costs to apply the shield and second dielectric layer. The unshielded alternative has a lower weight than the shielded version, with a typical weight of 13.5 grams per foot of cable, compared to 21–26 grams per foot of cable in the shielded version, a reduction of about ⅓ to ½. This makes use of the cable more comfortable for ultrasound technicians, reducing strain on cable terminations, and reducing fatigue for the user.

Embodiments that employ unshielded wires avoid another important design constraint. Normally, capacitance of a coaxial wire is dependent on the gap between the central conductor and the shield. To provide the low capacitance (high impedance) desired for certain critical applications, the diameter of each wire is constrained by this gap width, limiting miniaturization of a cable containing a given number of conductors, no matter how small the central conductor or shield wires. (This constraint is in addition to the practical manufacturing and cost limitations surrounding the manufacture of extremely fine coaxial wire.) However, without the need for wire shielding to protect against crosstalk, each wire may have a thin dielectric layer minimally required to provide insulation from adjoining wires and cable shielding. Even if the capacitance is limited by the spacing of a conductor from the conductors of adjacent wires, this enjoys the benefits of two thicknesses of wire insulation, allowing significant miniaturization.

To provide further reduced capacitance, one or both edge conductors of each ribbon may be grounded (necessitating the use of additional wires to provide a given number of signal-carrying wires.) It has been found that when one edge conductor is grounded at each end, the capacitance is increased for wires closest to the ground wire by about 1.0 pF. The capacitance is higher for wires farther from the ground, rising faster near the ground, in a curve that flattens out farther from the ground. Where lower and more consistent capacitance is desired, and additional wires tolerated, both edges of each ribbon are grounded. This provides comparable capacitance at the wires nearest the ground, with only a slight rise of about 0.2 pF for central wires away from the edges.

Basically, as discussed above, it would normally be expected that unshielded conductors yield unacceptably reduced crosstalk performance compared to coaxial conductors, particularly for the extended length of wire runs, small gauge of conductors, and close proximity of spacing. However, allowing the wires to remain loose through the majority of the cable length unexpectedly avoids this concern, common to normal ribbon cable. Because the wires are not connected to each other, and because there is adequate looseness of the cable sheath, the wires are allowed to move about, making it reliably unlikely that any two wires will remain closely parallel to each other, which would generate crosstalk problems. The flexing of the cable with use has the effect of shuffling the wires, so that none can be expected to remain adjacent to the same other wires over the entire cable length. With the controlled and organized ribbonization only at the ends, the one-to-one mapping allows connections to reliably and efficiently made, as discussed above.

Figure 8:
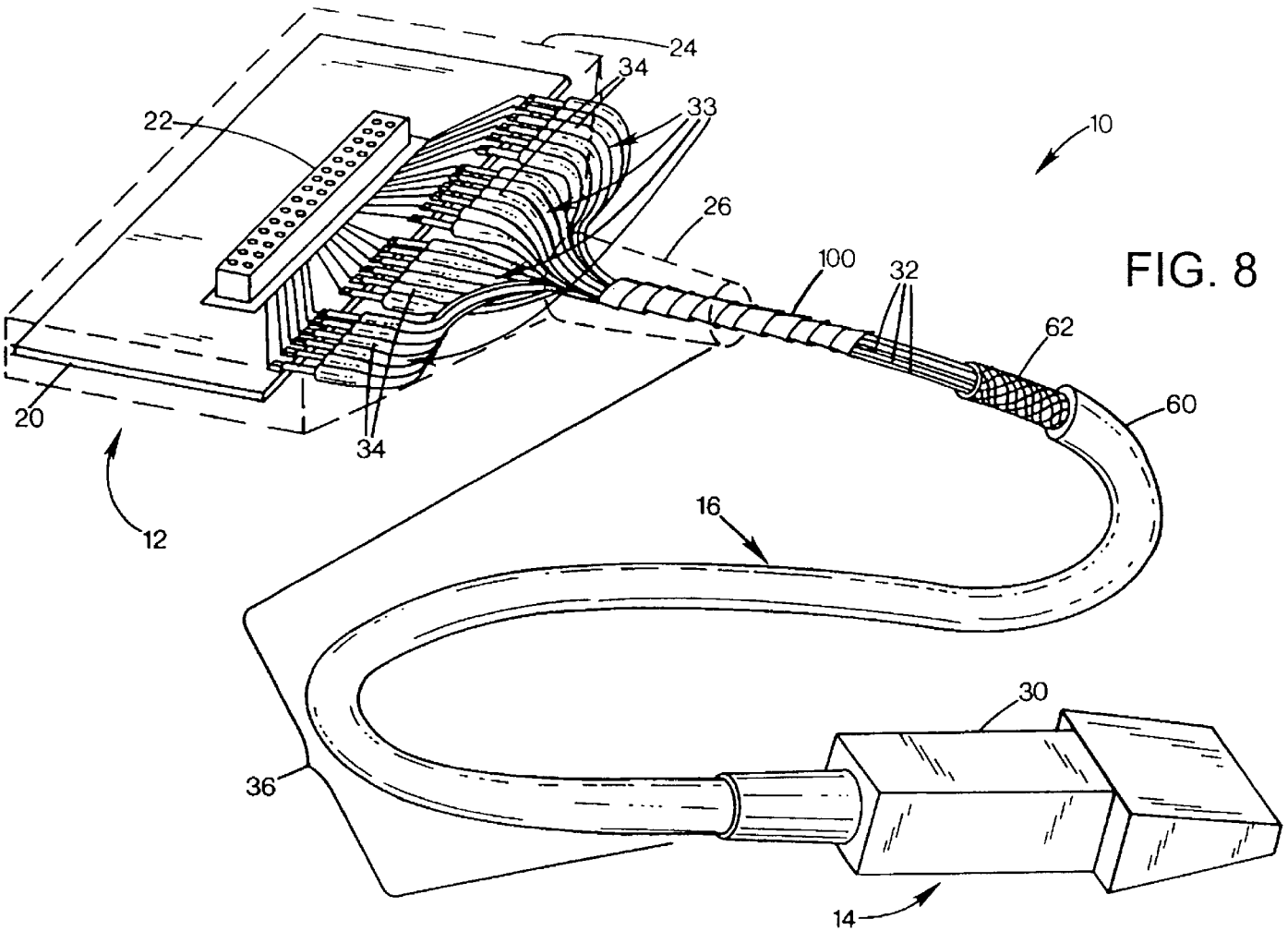
FIG. 8 is cutaway view of a cable assembly according to the alternative embodiment of the invention.

As shown in FIG. 8, either the preferred or alternative embodiment may be provided with a spiral wrap of flexible tape 100. The tape is wrapped about an end portion of the wires near the connector 12, but just before the wires diverge from the bundle to extend to the ribbonized portions 34. This tape wrap serves as a barrier to reduce the wearing and fatigue effects of repeated cable flexure, which is a particular concern for handheld corded devices. The wrapped portion thus extends the useful life of the cable. The wrapped barrier is applied at the end of the cable where repeated bending occurs. The barrier preferably extends over a length of approximately one foot. It has been demonstrated that wrapping the area with expanded PTFE tape is effective in providing long flex life, while not degrading the flexibility of the cable significantly. Preferably, the tape has a width of 0.5", a thickness of 0.002" a wrap pitch of 0.33", and is wrapped with a limited tension of 25 grams, so as to avoid a tight bundle with limited flexure.

LARGE-GROUND EMBODIMENT

Figure 9:
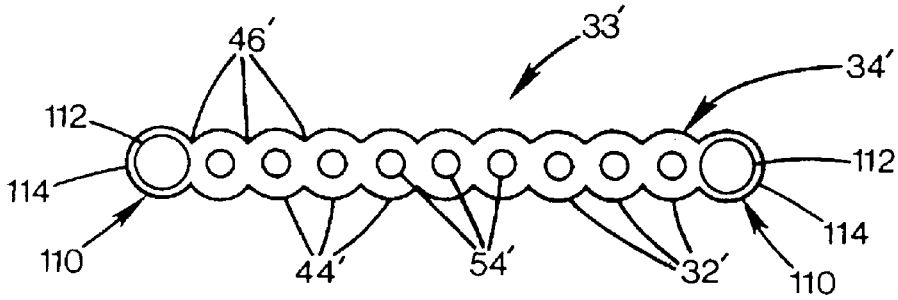
FIG. 9 is an enlarged cross-sectional view of a cable assembly component according to a further alternative embodiment of the invention.
Figure 10:
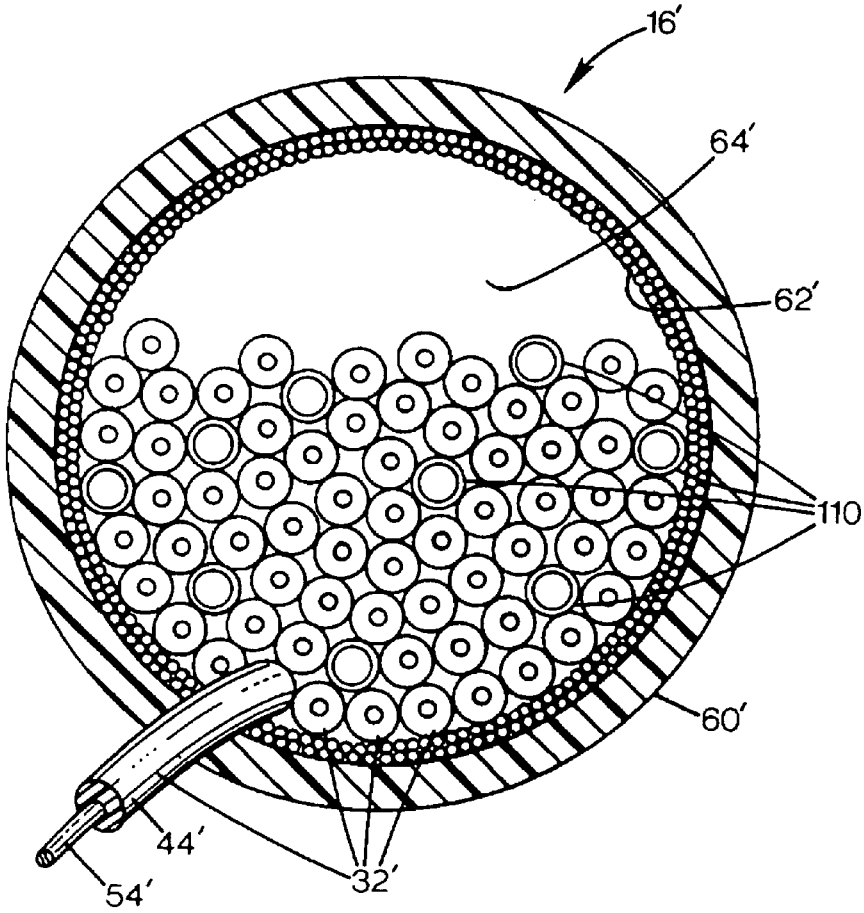
FIG. 10 is an enlarged cross-sectional view of a cable assembly according to the alternative embodiment of FIG. 9.

FIG. 9 shows a cross section of a representative end portion 34" of a wire group 33" according to an alternative embodiment of the invention. The alternative embodiment differs from the above embodiments in that in addition to the signal-carrying wires 32' that make up the cable, there are additional ground conductors 110 having larger gauge conductors 112, and thin insulation layers 114. Preferably, the outside diameter of the insulated ground wires 110 is about the same as that of the signal carrying wires. Consequently, the ends are flat ribbons of consistent thickness, and the grounds tend to distribute themselves randomly among the signal carrying wires 32' as shown in FIG. 10.

As noted above, the signal wires are preferably 40 AWG copper (0.0026" diameter), surrounded by a dielectric wall thickness of 0.006", providing an overall wire outside diameter of 0.015". The ground does not carry high-frequency signals, so does not require a certain dielectric thickness; only minimal insulation to prevent ohmic contact with other conductors is required. Accordingly, the ground is 32 AWG copper (0.008" diameter), with a 0.0045 nominal insulation thickness, providing an outside diameter of 0.017".

In alternative embodiments, the ground wires may be smaller or larger than in the preferred embodiment, but it is preferred to have the ground significantly larger than the signal wires to provide adequate conductivity. The use of two grounds per ribbon, on the edges of each ribbon is believed to provide more consistent capacitance in the ribbonized sections, and to reduce any edge effects that might occur if a signal wire were positioned at the edge.

However, it is not essential to have exactly two grounds per ribbon, nor that all grounds be at the edges of the ribbons. In alternative embodiments, grounds may be interspersed among the signal wires. Where a higher capacitance is desired, and cable weight and diameter are less critical, the number of grounds may equal or exceed the number of signal wires, such as provided by alternating grounds and signal wires. The capacitance may be tuned for each application by employing a selected number of ground wires that are demonstrated theoretically or experimentally to provide the desired capacitance (or impedance). The number of wires may also be expressed as a proportion of the numbers of ground wires to the number of signal wires. In other alternative embodiments, the non-ground wires may be shielded as conventional coaxial cable.

To provide more ground wires, grounds may be interspersed every nth position along a ribbon, such as to provide ground wires alternating with sets of multiple signal wires (e.g. Ground, Signal, Signal, Ground, Signal, Signal, Ground, Signal, Signal, Ground.) In further alternative embodiment, the grounds need not be included on the same ribbons as the signal wires, but may be separate wires, or connected in their own ribbon. In any event, the grounds are loose with respect to each other and to the signal wires in the intermediate portion, so that they enjoy the benefits of randomization discussed above.

It is believed that the use in the prior art of relatively high impedance conductors for both signals and grounds limits the performance of the cable in ultrasound applications. Specifically, the high impedance of the conductors used as ground returns for the signal have a high impedance, which results in a "signal divider" effect which induces noise on nearby conductors. Traditional coax shields used in ultrasound applications contain more metal (which means lower resistance and impedance.) Also, adjacent signal lines in coaxially shielded versions are separated by two shields (the ones around each signal conductor).

The use of larger grounds provides lower impedance performance, without the bulk, cost and weight of these traditional approaches. The combination with the loose shield, and the tendency to randomly associate with different conductors along the length of the intermediate portion further, ensures that signal conductors are comparably influenced by ground wires that are adjacent for only limited portions of the cable length.

While the above is discussed in terms of preferred and alternative embodiments, the invention is not intended to be so limited. For instance, instead of loose wires entirely independent of each other in the intermediate portion, the wires may be arranged in groups that are loose with respect to other groups. These groups may include parallel pairs (as if a 2-wire ribbon), twisted pairs, triples, and other configurations.

What is claimed is:

1. A cable assembly comprising:

a plurality of wires, each having a first end and an opposed second end;

the first ends of the wires being arranged in a first sequence;

the second ends of the wires being arranged in a second sequence based on the first sequence;

the wires having intermediate portions between the first and second ends, the intermediate portions of each wire being detached from the intermediate portions of others of the wires;

a conductive shield loosely surrounding the intermediate portions of the wires;

the wires each having a single central conductor surrounded by a nonconductive insulating layer; and the insulating layer of each wire directly contacting the insulating layers of at least some of others of the wires.

2. The cable assembly of claim 1 wherein the insulating layer of each wire is a single layer of a single material.

3. The cable assembly of claim 1 wherein each wire is unshielded with respect to the other wires.

4. The cable assembly of claim 1 wherein the central conductors of the intermediate portions of the wires are separated from the central conductors of the intermediate portions of the others of the wires only by non-conductive materials.

5. The cable assembly of claim 1 wherein the wires are arranged differently with respect to each other at different positions along the length of the intermediate portions.

6. The cable assembly of claim 1 wherein the first and second ends are ribbonized.

7. The cable assembly of claim 1 wherein the first ends of the wires are arranged in parallel, adjacent to each other, in a selected sequence, and the second ends of the wires are arranged in parallel, adjacent to each other, in the selected sequence.

8. The cable assembly of claim 7 wherein the selected sequence has a first and last wire, and wherein at least one of the first and last wires is grounded.

9. The cable assembly of claim 8 wherein both the first and last wires are grounded.

10. The cable assembly of claim 1 wherein each of the wires is entirely non-conductive except for the central conductor.

11. The cable assembly of claim 1 wherein each of the conductors is separated at the first end and at the second end from the conductor of an adjacent wire only by non-conductive insulating material.

12. The cable assembly of claim 1 wherein the wires include a plurality of signal wires having conductors of a first diameter, and a plurality of ground wires having conductors of a larger second diameter.

13. The cable assembly of claim 12 wherein at least some of the ground wires are positioned at edge portions of the first sequence and the second sequence.

14. The cable assembly of claim 12 wherein the ground wires are encompassed with an insulating layer having an outside diameter equal to the outside diameter of the insulated signal wires.

15. The cable assembly of claim 12 including a number of said ground wires selected to provide a selected impedance level.

16. A cable assembly comprising:

a plurality of wires, each having a first end and an opposed second end;

the wires having intermediate portions between the first and second ends, the intermediate portions being detached from each other, a conductive shield loosely surrounding the intermediate portions of the wires;

each wire having a conductor surrounded by a nonconductive insulating layer; and wherein each wire is unshielded with respect to the other wires.

17. The cable assembly of claim 16 wherein the insulating layer of each wire is a single layer of a single material.

18. The cable assembly of claim 16 wherein each wire is entirely non-conductive except for a central conductor.

19. The cable assembly of claim 16 wherein the conductors of the intermediate portions of the wires are separated from the conductors of the intermediate portions of others of the wires only by non-conductive materials.

20. The cable assembly of claim 16 wherein the wires are arranged differently with respect to each other at different positions along the length of the intermediate portions.

21. The cable assembly of claim 16 wherein the first ends of the wires are arranged in parallel, adjacent to each other, in a selected sequence, and the second ends of the wires are arranged in parallel, adjacent to each other, in the selected sequence.

22. The cable assembly of claim 21 wherein the selected sequence has a first wire and a last wire, and wherein at least one of the first wire and the last wire is grounded.

23. The cable assembly of claim 16 wherein each of the wires is separated at the first end and at the second end from the conductors of an adjacent wire only by non-conductive insulating material.

24. The cable assembly of claim 16 wherein the wires include a plurality of signal wires having conductors of a first diameter, and a plurality of ground wires having conductors of a larger second diameter.

25. A cable assembly comprising:

a plurality of wires, each having a first end and an opposed second end;

the first ends of the wires are arranged in parallel, adjacent to each other, in a selected sequence, and the second ends of the wires are arranged in parallel, adjacent to each other, in the selected sequence;

the wires having unshielded intermediate portions between the first and second ends, the intermediate portions being detached from each other;

a conductive shield loosely surrounding the intermediate portions of the wires, such that the wires are arranged differently with respect to each other at different positions along the length of the intermediate portions; and each wire being entirely non-conductive except for a central conductor surrounded by a nonconductive insulating layer.

26. The cable assembly of claim 25 wherein the wires include a plurality of signal wires having conductors of a first diameter, and a plurality of ground wires having conductors of a larger second diameter.

* * * * *